US010602888B2

(12) United States Patent
Troutman et al.

(10) Patent No.: US 10,602,888 B2
(45) **Date of Patent: *Mar. 31, 2020**

(54) PORTABLE, VERTICALLY ORIENTED AUTOMATIC TOWEL DISPENSER APPARATUS

(71) Applicant: GPCP IP HOLDINGS LLC, Atlanta, GA (US)

(72) Inventors: William Bryant Troutman, Charlotte, NC (US); William Bryant Troutman, II, Charlotte, NC (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/227,929

(22) Filed: Dec. 20, 2018

(65) Prior Publication Data

US 2019/0117025 A1 Apr. 25, 2019

Related U.S. Application Data

(63) Continuation of application No. 15/582,766, filed on Apr. 30, 2017, now Pat. No. 10,165,907, which is a (Continued)

(51) Int. Cl.
*A47K 10/36* (2006.01)
*A47K 10/32* (2006.01)

(52) U.S. Cl.
CPC ..... *A47K 10/36* (2013.01); *A47K 10/3612* (2013.01); *A47K 2010/3233* (2013.01)

(58) Field of Classification Search
CPC ..... A47K 1/09; A47K 17/00; A47K 3/281; A47K 10/24; A47K 10/36; A47K 10/38; (Continued)

(56) References Cited

U.S. PATENT DOCUMENTS 1,761,464 A 6/1930 Caps
2,135,767 A 11/1938 Price et al.
(Continued)

FOREIGN PATENT DOCUMENTS

CN 209712725 U 12/2019
EP 0573558 A1 12/1993
(Continued)

OTHER PUBLICATIONS

Innovia WB2-159S Automatic Paper Towel Dispenser, retrieved Feb. 1, 2018 from <https://www.amazon.com/gp/product/B008HDREZ6/ref=s9_acsd_hps_bw_- cr.
(Continued)

*Primary Examiner* — William A. Rivera
(74) *Attorney, Agent, or Firm* — Nelson Mullins Riley & Scarborough LLP

(57) ABSTRACT

A portable towel dispenser includes a housing configured to stand upright and an interior space for receiving a toweling assembly including a roll of towels on an arbor. The interior space is configured to receive in a vertical orientation the arbor for vertical support thereof during unwinding of the roll of towels. A loading door is configured to rotate relative to the housing about a generally vertical axis between a closed position, in which the loading door and housing together enclose the toweling assembly within the dispenser, and an open position, in which the dispenser is configured to receive the toweling assembly therein without obstruction by the loading door. The dispenser is battery operated, includes a handle, and is readily hand portable. A button on a bottom of the housing is depressed to enable dispensing when the housing is stood upright.

20 Claims, 5 Drawing Sheets

Related U.S. Application Data continuation of application No. 14/468,316, filed on Aug. 25, 2014, now Pat. No. 9,642,503.

(60) Provisional application No. 61/869,720, filed on Aug. 25, 2013.

(58) Field of Classification Search
CPC ..... A47K 10/3836; A47K 2010/3233; B65H 75/04; B65H 75/14; B65H 35/002; B65H 2701/1752
See application file for complete search history.

(56) References Cited

U.S. PATENT DOCUMENTS 2,193,759 A 3/1940 Birr
RE22,565 E 11/1944 Gillanders et al.
2,487,763 A 11/1949 Patterson et al.
3,575,328 A 4/1971 Jespersen et al.
3,730,409 A 5/1973 Ratti
RE28,911 E 7/1976 Jespersen et al.
4,131,044 A 12/1978 Cassia
4,137,805 A 2/1979 DeLuca et al.
4,142,431 A 3/1979 Jespersen
4,188,844 A 2/1980 DeLuca
4,191,307 A 3/1980 LeCaire, Jr. et al.
4,203,562 A 5/1980 DeLuca et al.
4,206,858 A 6/1980 DeLuca et al.
4,236,679 A 12/1980 Jespersen
4,286,489 A 9/1981 DeLuca
4,307,638 A 12/1981 DeLuca et al.
4,307,639 A 12/1981 DeLuca
4,340,195 A 7/1982 DeLuca
4,404,880 A 9/1983 DeLuca
4,611,768 A 9/1986 Voss et al.
4,666,099 A 5/1987 Hoffman et al.
4,738,176 A 4/1988 Cassia
4,817,483 A 4/1989 Armbruster
4,848,690 A 7/1989 Lemoine
4,856,724 A 8/1989 Jespersen
4,944,466 A 7/1990 Jespersen
D312,369 S 11/1990 De Luca et al.
4,984,530 A 1/1991 Dutton
D316,788 S 5/1991 Fischer et al.
5,020,403 A 6/1991 D'Angelo et al.
5,048,386 A 9/1991 DeLuca et al.
5,078,033 A 1/1992 Formon
5,107,734 A 4/1992 Armbruster
5,137,173 A 8/1992 Hughes et al.
5,249,755 A 10/1993 Jespersen
5,271,574 A 12/1993 Formon et al.
5,288,032 A 2/1994 Boone et al.
5,294,192 A 3/1994 Omdoll et al.
5,305,937 A 4/1994 Barnett
5,314,131 A 5/1994 McCanless et al.
5,375,785 A 12/1994 Boone et al.
5,441,189 A 8/1995 Formon et al.
5,452,832 A 9/1995 Niada
5,526,973 A 6/1996 Boone et al.
5,558,302 A 9/1996 Jesperson
5,601,253 A 2/1997 Formon et al.
5,765,717 A 6/1998 Gottselig
5,772,291 A 6/1998 Byrd et al.
5,924,617 A 7/1999 LaCount et al.
5,979,821 A 11/1999 LaCount et al.
5,979,822 A 11/1999 Morand et al.
D419,014 S 1/2000 Fluegge et al.
D419,805 S 2/2000 Fluegge et al.
6,032,898 A 3/2000 LaCount et al.
6,105,898 A 8/2000 Byrd et al.
6,152,397 A 11/2000 Purcell
6,161,796 A 12/2000 Daniels
6,237,871 B1 5/2001 Morand et al.
6,250,530 B1 6/2001 LaCount et al.
6,354,533 B1 3/2002 Jespersen
6,412,679 B2 7/2002 Formon et al.
6,419,136 B2 7/2002 Formon et al.
6,554,158 B2 4/2003 Kapiloff et al.
6,607,160 B2 8/2003 Lewis et al.
6,695,246 B1 2/2004 Elliott et al.
6,710,606 B2 3/2004 Morris
6,736,348 B1 5/2004 Formon et al.
6,736,466 B1 5/2004 Helland et al.
6,742,689 B2 6/2004 Formon et al.
6,745,927 B2 6/2004 Formon et al.
6,758,434 B2 7/2004 Kapiloff et al.
6,766,977 B2 7/2004 Denen et al.
6,826,985 B2 12/2004 Broehl
6,826,991 B1 12/2004 Rasmussen
6,830,210 B2 12/2004 Formon et al.
6,854,684 B2 2/2005 Byrd et al.
6,871,815 B2 3/2005 Moody et al.
6,902,134 B2 6/2005 Green et al.
6,903,654 B2 6/2005 Hansen et al.
6,929,213 B1 8/2005 Contreras
6,952,067 B2 10/2005 Tanaka et al.
6,959,891 B2 11/2005 Kapiloff et al.
6,964,395 B1 11/2005 Lewis et al.
6,988,689 B2 1/2006 Thomas et al.
6,994,408 B1 2/2006 Bunnell
7,017,856 B2 3/2006 Moody et al.
7,040,566 B1 5/2006 Rodrian et al.
7,040,567 B1 5/2006 Lewis et al.
D522,781 S 6/2006 Wieser et al.
7,114,677 B2 10/2006 Formon et al.
7,168,602 B2 1/2007 Broehl
7,182,289 B2 2/2007 Moody et al.
7,185,841 B2 3/2007 Kaufmann
7,185,842 B2 3/2007 Lewis et al.
7,191,977 B2 3/2007 Denen et al.
7,219,852 B2 5/2007 Tramontina et al.
7,237,744 B2 7/2007 Morris et al.
D550,999 S 9/2007 Formon et al.
7,296,765 B2 11/2007 Rodrian
D564,269 S 3/2008 Paal et al.
7,338,008 B1 3/2008 Jenkins
7,341,170 B2 3/2008 Boone
7,347,134 B2 3/2008 Lewis et al.
7,387,274 B2 6/2008 Moody et al.
7,406,901 B2 8/2008 Schmidt et al.
7,438,256 B2 10/2008 Nip et al.
7,530,524 B2 5/2009 Wieser et al.
7,533,845 B2 5/2009 Neveu et al.
7,553,098 B2 6/2009 Maekawa et al.
7,568,652 B2 8/2009 Cittadino et al.
7,594,622 B2 9/2009 Witt et al.
7,624,664 B2 12/2009 Morris et al.
7,689,980 B2 3/2010 Du et al.
7,698,980 B2 4/2010 Morris et al.
7,774,096 B2 8/2010 Goerg et al.
7,783,380 B2 8/2010 York et al.
7,821,155 B2 10/2010 Reinsel et al.
7,832,679 B2 11/2010 Denen et al.
7,845,593 B2 12/2010 Formon et al.
7,878,446 B2 2/2011 Reinsel et al.
7,887,005 B2 2/2011 Troutman et al.
7,946,522 B2 5/2011 Lewis et al.
7,963,475 B2 6/2011 Rodrian
8,079,540 B2 12/2011 Troutman et al.
8,079,541 B2 12/2011 Troutman et al.
8,079,542 B2 12/2011 Troutman et al.
8,079,543 B2 12/2011 Troutman et al.
8,083,170 B2 12/2011 Troutman et al.
8,186,551 B2 5/2012 Morris et al.
8,231,075 B2 7/2012 Troutman et al.
8,231,076 B2 7/2012 Troutman et al.
8,240,594 B2 8/2012 Troutman et al.
8,336,803 B2 12/2012 Troutman et al.
8,434,709 B2 5/2013 Troutman et al.
8,464,976 B2 6/2013 Mok et al.
8,561,933 B2 10/2013 Troutman et al.
8,632,030 B2 1/2014 Troutman et al.
9,144,352 B2 9/2015 Cittadino et al.
9,282,855 B2 3/2016 Troutman et al.

(56) References Cited

U.S. PATENT DOCUMENTS

| | | | | |
|---|---|---|---|---|
| 9,307,875 | B2 | 4/2016 | Clarkin | |
| 9,474,422 | B1 | 10/2016 | Troutman et al. | |
| 9,480,370 | B2 | 11/2016 | Troutman et al. | |
| 9,596,964 | B1 | 3/2017 | Troutman et al. | |
| 9,642,503 | B1 * | 5/2017 | Troutman | A47K 10/36 |
| D807,663 | S | 1/2018 | Taylor | |
| 10,165,907 | B1 * | 1/2019 | Troutman | A47K 10/36 |
| 2003/0019971 | A1 | 1/2003 | Lewis et al. | |
| 2003/0168550 | A1 | 9/2003 | Formon et al. | |
| 2004/0251375 | A1 | 12/2004 | Denen et al. | |
| 2005/0150992 | A1 | 7/2005 | Morris et al. | |
| 2005/0171634 | A1 | 8/2005 | York et al. | |
| 2006/0006275 | A1 | 1/2006 | Neveu et al. | |
| 2006/0138274 | A1 | 6/2006 | Goeking et al. | |
| 2006/0169827 | A1 | 8/2006 | Lewis et al. | |
| 2006/0173576 | A1 | 8/2006 | Goerg et al. | |
| 2007/0080255 | A1 | 4/2007 | Witt et al. | |
| 2007/0152010 | A1 | 7/2007 | Denen et al. | |
| 2007/0158359 | A1 | 7/2007 | Rodrian | |
| 2007/0194166 | A1 | 8/2007 | Reinsel et al. | |
| 2008/0011772 | A1 | 1/2008 | Morris et al. | |
| 2008/0018302 | A1 | 1/2008 | Reinsel et al. | |
| 2008/0078777 | A1 | 4/2008 | Cittadino et al. | |
| 2008/0087758 | A1 | 4/2008 | Formon et al. | |
| 2008/0099595 | A1 | 5/2008 | Lewis et al. | |
| 2009/0065626 | A1 | 3/2009 | Petri | |
| 2009/0065628 | A1 | 3/2009 | Troutman et al. | |
| 2010/0219280 | A1 | 9/2010 | Troutman et al. | |
| 2010/0219281 | A1 | 9/2010 | Troutman et al. | |
| 2010/0219282 | A1 | 9/2010 | Troutman et al. | |
| 2010/0219283 | A1 | 9/2010 | Troutman et al. | |
| 2010/0219284 | A1 | 9/2010 | Troutman et al. | |
| 2010/0314429 | A1 | 12/2010 | Troutman et al. | |
| 2011/0068209 | A1 | 3/2011 | Troutman et al. | |
| 2011/0068210 | A1 | 3/2011 | Troutman et al. | |
| 2011/0068211 | A1 | 3/2011 | Troutman et al. | |
| 2011/0068212 | A1 | 3/2011 | Troutman et al. | |
| 2011/0068213 | A1 | 3/2011 | Troutman et al. | |
| 2011/0068214 | A1 | 3/2011 | Troutman et al. | |
| 2011/0068215 | A1 | 3/2011 | Troutman et al. | |
| 2011/0068216 | A1 | 3/2011 | Troutman et al. | |
| 2011/0068217 | A1 | 3/2011 | Troutman et al. | |
| 2011/0068218 | A1 | 3/2011 | Troutman et al. | |
| 2011/0068219 | A1 | 3/2011 | Troutman et al. | |
| 2012/0104141 | A1 | 5/2012 | Troutman et al. | |
| 2012/0305696 | A1 | 12/2012 | Troutman et al. | |
| 2014/0021286 | A1 | 1/2014 | Troutman et al. | |
| 2014/0021287 | A1 | 1/2014 | Troutman et al. | |
| 2014/0131506 | A1 | 5/2014 | Clarkin | |
| 2016/0287036 | A1 | 10/2016 | Troutman et al. | |
| 2017/0042393 | A1 | 2/2017 | Troutman et al. | |
| 2018/0289224 | A1 | 10/2018 | Troutman et al. | |
| 2018/0317719 | A1 | 11/2018 | Troutman et al. | |
| 2019/0183297 | A1 | 6/2019 | Troutman et al. | |
| 2020/0037829 | A1 | 2/2020 | Troutman et al. | |

FOREIGN PATENT DOCUMENTS

| | | | |
|---|---|---|---|
| JP | H05111442 | A | 5/1993 |
| JP | 2007014367 | A | 1/2007 |
| WO | 98053728 | A1 | 12/1998 |
| WO | 2010141931 | A2 | 12/2010 |

OTHER PUBLICATIONS

International Search Report and Written Opinion of the International Search Authority (Korean Intellectual Property Office) for International PatentApplication Serial No. PCT/US2010/037561, dated Jan. 10, 2011.

* cited by examiner

PORTABLE, VERTICALLY ORIENTED AUTOMATIC TOWEL DISPENSER APPARATUS

CROSS-REFERENCE TO RELATED APPLICATIONS

This application claims priority to and is a continuation of U.S. patent application Ser. No. 15/582,766, entitled "Portable, Vertically Oriented Automatic Towel Dispenser Apparatus" filed Apr. 30, 2017, which is a continuation of U.S. patent application Ser. No. 14/468,316, entitled "Portable, Vertically Oriented Automatic Towel Dispenser Apparatus" filed Aug. 25, 2014, issued as U.S. Pat. No. 9,642,503, which claims priority to U.S. Provisional Patent Application No. 61/869,720, entitled "Portable, Vertically Oriented Automatic Towel Dispenser Apparatus" filed Aug. 25, 2013, each of which is hereby incorporated by reference in its entirety.

INCORPORATION BY REFERENCE

The present application hereby incorporates by reference U.S. Patent Application Publication Nos. 2009/0065626; 2010/0219280; 2010/0219281; 2010/0219282, 2010/0219283; 2010/0219284; 2010/0314429; 2011/0068209; 2011/0068210; 2011/0068211; 2011/0068212; 2011/0068213; 2011/0068214; 2011/0068215; 2011/0068216; 2011/0068217; 2011/0068218; 2011/0068219; 2012/0104141; 2012/0305696. Furthermore, the present application hereby incorporates by reference the disclosure of the Appendix attached hereto, including all of the exhibits therein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to towel dispensers and, more particularly, to towel dispensers in which a length of toweling is extended from the housing for grasping and pulling by a user for separation and dispensing of one or more towels. In preferred embodiments of the invention, the toweling comprises a roll of perforated towels, in which the towels are connected together and separable at perforation formed between the towels.

Towel dispensers are well known and generally include a housing configured to receive toweling; a guide system that defines a path within the housing and that guides the toweling along the path during movement of the toweling while towels are dispensed; and a motor that moves the toweling along the path to the exterior of the housing, thereby exteriorly extending the toweling from the housing. The guide system can include rollers or fixed guides and typically includes one or more driven rollers connected to the motor by a transmission. A switch or sensor for detecting motion or proximity of an object—such as a hand—is provided to initiate the operation of the motor. For example, in a known dispenser, a controller is electrically connected to the sensor and is configured to activate the motor when the sensor generates a signal that indicates the presence of the wave of a hand.

Conventional towel dispensers generally operate as follows. A roll of toweling is placed within the housing and threaded through the guide system. A user causes a towel to be dispensed by placing a hand or other object near the sensor. Alternatively, the dispensing of toweling can be initiated by pressing a button or switch that is configured to activate the motor. Dispensing of the toweling is stopped when a predetermined length of toweling has been dispensed. Alternatively, in some cases the toweling is stopped when the hand is removed or button/switch is released.

Conventional towel dispensers are disclosed in each of U.S. Pat. Nos. 6,412,679; 6,419,136; 6,742,689; 6,745,927; 6,766,977; and 7,191,977. Each of these U.S. patents is incorporated herein by reference.

Even in view of known towel dispensers, it is believed that one or more needs exist for advancements in towel dispensers.

SUMMARY OF THE INVENTION

The present invention includes many aspects and features. Moreover, while many aspects and features relate to, and are described in, the context of toweling including a roll of sheet material separated by perforations that define towels when separated, the present invention is not limited to use only in such context, and may be used with toweling that does not include such perforations. Moreover, while preferred implementations relate to automatic dispensing of paper towels, the invention is not necessarily limited to such implementations and is applicable, for example, in implementations relating to the manual and automatic dispensing of other types of toweling, including toilet paper.

Accordingly, in an aspect of the invention, a towel dispenser includes a housing and a loading door. The housing is configured to stand upright in a vertical orientation and defines an interior space for receiving a loading door. The loading door in turn defines a second interior space, at least a portion of which is coextensive with the interior space of the housing, in which second interior space a toweling assembly is received including a roll of towels on an arbor. In particular, the loading door is configured to receive in a vertical orientation the arbor for vertical support of the roll of towels during unwinding of the roll of towels and dispensing of toweling. The loading door includes one or more rollers extending along a section of the interior side of the loading door and is configured to rotate relative to the housing about a generally vertical axis between: a closed position, in which the loading door and the housing are configured to receive an extent of toweling therebetween for dispensing of the toweling, and in which the loading door closes off access to toweling received within the dispenser; and an open position, in which the dispenser is configured to receive toweling therein without obstruction by the loading door.

In features of this aspect, the dispenser is battery operated, includes a handle, and is hand portable.

In another feature, the towel dispenser is configured to receive the toweling assembly therein for dispensing by moving the loading door to the open position; inserting the arbor with a roll of towels disposed thereon into the interior space of the loading door (and the interior space of the housing in which the loading door is disposed), with opposite top and bottom ends of the arbor being received within a recessed area of the loading door such that the toweling assembly is rotatable while supported in the vertical orientation; and moving the loading door into the closed position with an extent of the toweling extending between the loading door and the main body. Preferably, towel dispenser is further configured such that no further manual threading or manual positioning of the toweling is required to install the toweling for dispensing.

In another feature, a button located on a bottom of the housing of the dispenser must be depressed in order to enable automatic dispensing of toweling. The button is depressed when the housing is stood upright in a vertical orientation for dispensing of toweling. This guards against undesired dispensing of toweling when the dispenser is picked up and carried.

In another feature, the dispenser includes toweling received within the interior space. The toweling may comprise a perforated roll of towels and, preferably, a roll of perforated paper towels.

In a feature, the dispenser further comprises an LED for indicating a status of the towel dispenser.

In another aspect, a towel dispenser includes a housing configured to stand upright in a vertical orientation and defining an interior space for receiving a loading door containing a toweling assembly. The loading door is configured to receive in a vertical orientation the toweling assembly for vertical support thereof during unwinding and dispensing of toweling. The loading door is further configured to rotate relative to the housing about a generally vertical axis between: a closed position, in which the loading door and the housing are configured to receive an extent of toweling therebetween for dispensing of the toweling, and in which the loading door closes off the toweling assembly from access; and an open position, in which the dispenser is configured to receive the toweling assembly therein without obstruction by the loading door.

In a feature, the toweling assembly comprises an arbor.

In a feature, the toweling assembly comprises a roll of towels.

In a feature, the toweling assembly comprises both a roll of towels and an arbor extending through an axial opening of the roll of towels. Furthermore, the arbor preferably includes a section comprising a bulge for frictional engagement and support of the roll of towels on the arbor during unwinding of the roll. The arbor preferably is removable from the roll of towels by sliding of the arbor relative to the roll of towels, such that a subsequent roll of towels is disposable on the arbor for use in the towel dispenser, whereby the arbor is reusable.

In another feature, a safeguard located on a bottom of the housing prevents dispensing of toweling unless the safeguard is engaged, such as by positioning the housing on a surface such that the surface abuts the safeguard. The safeguard may comprise a depressible button or other type of switch. For instance, the safeguard may comprise a button located on a bottom of the housing that prevents dispensing of toweling unless the button is depressed. In this example, the button preferably is depressed when the housing is positioned to stand upright in a generally vertical orientation on a generally horizontal, planar surface.

In another feature, the dispenser further comprises one or more rollers that engage the extent of toweling between the loading door and the housing when the loading door is in the closed position. The one or more rollers may comprise one or more rollers extending along a section of the interior side of the loading door, and one or more rollers extending along a corresponding section of the housing when the loading door is in the closed position. Furthermore, the one or more of the one or more rollers preferably are driven by a motor assembly of the dispenser.

In another feature, the dispenser further comprises a sensor mounted to the main body and configured to sense a leading edge of the toweling between a gap formed by the main body and the loading door when the loading door is in the closed position.

In another feature, the dispenser further comprises a sensor located on an exterior surface of the main body for detecting motion and for causing a motor assembly to drive one or more rollers for advancing toweling outside of the housing when either an object or motion is detected by the sensor, wherein the sensor is located proximate a top of the housing. Additionally, the dispenser preferably further comprises a strap for carrying of the towel dispenser, the strap being located on a top of the housing; and further comprises a light indicator for indicating a status of the towel dispenser, the light indicator being located on an exterior surface of the housing proximate a top of the housing.

Still yet other aspects and features of the invention are shown in the disclosure of the Exhibits of the Appendix attached hereto and incorporated herein by reference.

In addition to the aforementioned aspects and features of the present invention, it should be noted that the present invention further encompasses the various possible combinations and subcornbinations of such aspects and features. Thus, for example, any aspect may be combined with a feature in accordance with the present invention without requiring any other aspect or feature.

Furthermore, other aspects and features of the invention includes the methods, apparatus, and operational logic of towel dispensers as disclosed in the above incorporated U.S. Patent Application Publications of the first paragraph, when combined and not inconsistent with the aspects and features explicitly discussed herein. Thus, for example, embodiments of the towel dispenser in accordance with one or more aspects and features of the present invention include towel dispensers that utilize the length learn logic for dispensing toweling as disclosed in one or more of the incorporated U.S. patent references. The sequence for such method is represented in the sequential photographs on page 1 of Exhibit A of the Appendix.

BRIEF DESCRIPTION OF THE DRAWINGS

One or more preferred embodiments of the present invention are represented in the drawings.

Figure 1:
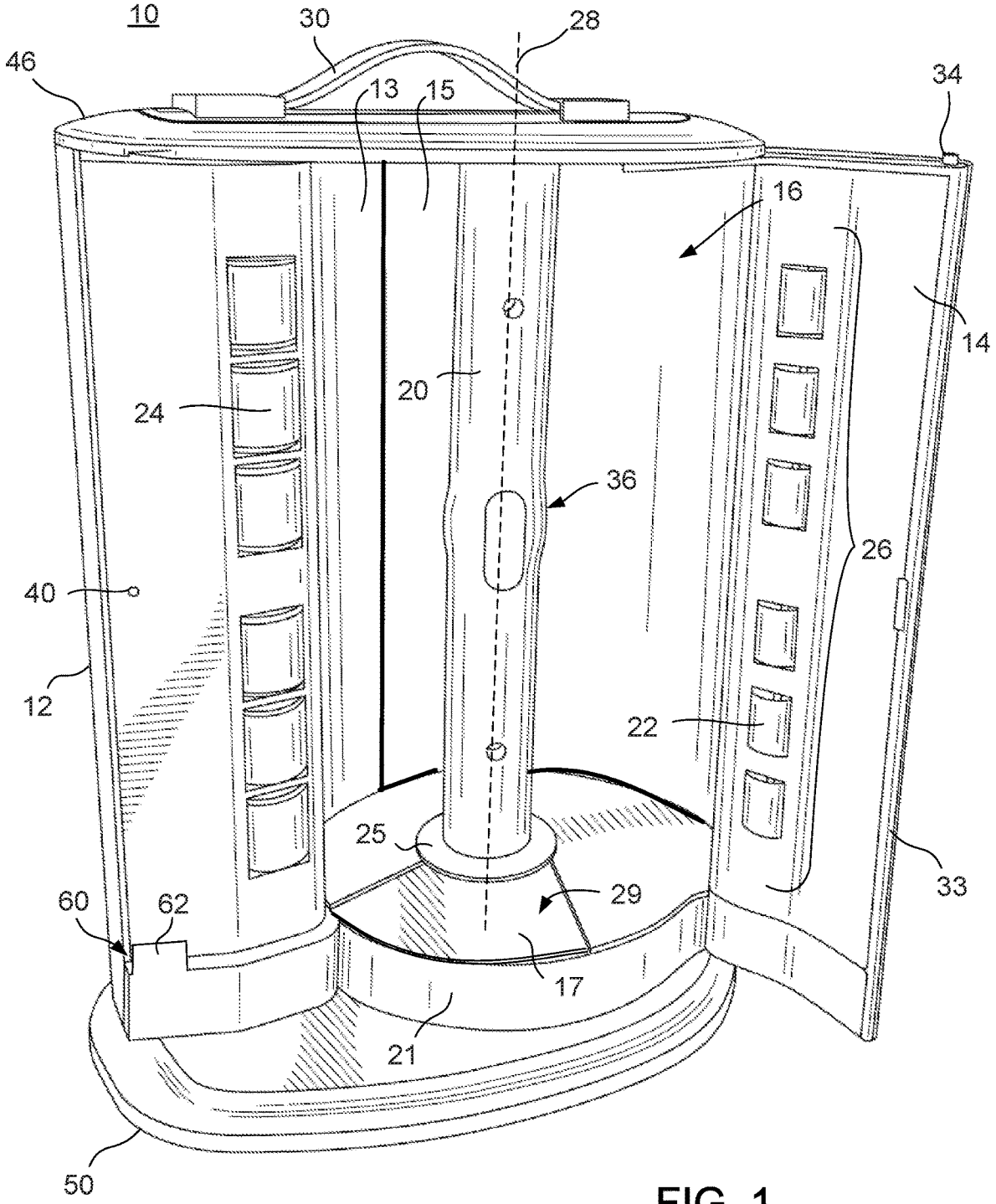
FIG. 1 is a perspective view of an automatic paper towel dispenser apparatus in accordance with a preferred embodiment of the invention, wherein a loading door is in an open position.
Figure 2:
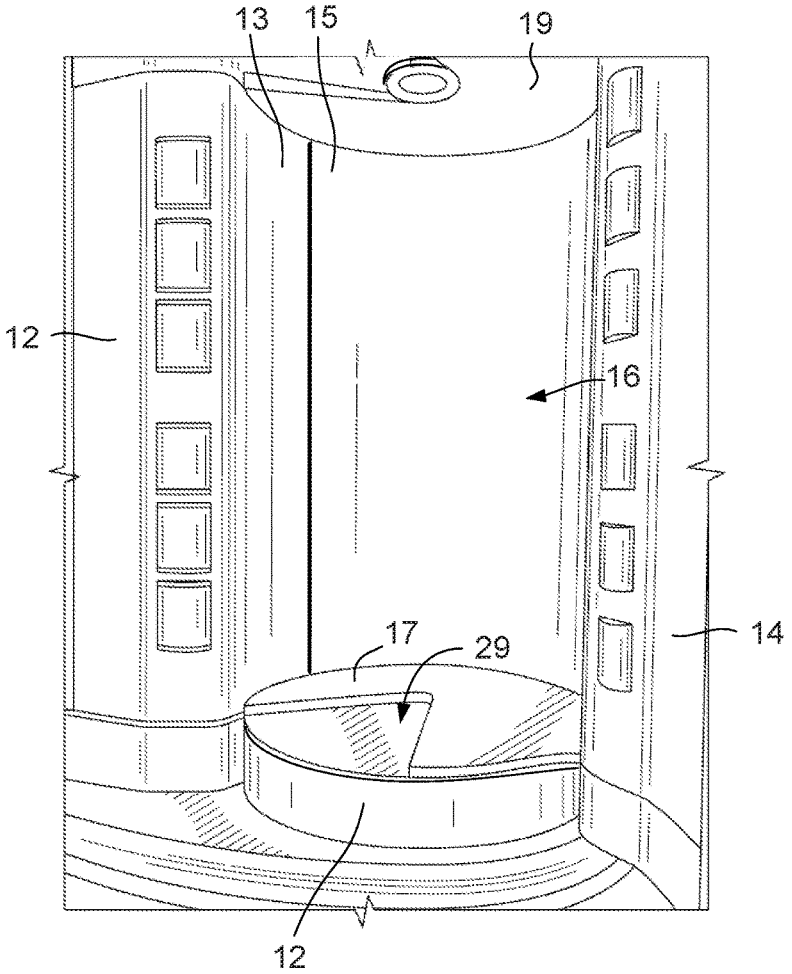
FIG. 2 is a close-up view of the automatic paper towel dispenser apparatus of FIG. 1, wherein the arbor has been removed from an interior of the dispenser.

Additional views of embodiments of automatic paper towel dispenser apparatus in accordance with one or more aspects and features of the invention are shown in the Appendix.

DETAILED DESCRIPTION

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the full scope of the present invention that is contemplated. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Finally, it will be understood from the foregoing that, as used herein when describing the towel dispenser apparatus of the drawings, "vertical" and like words are intended to mean along the lines of the force of gravity, with "upward" and like words meaning in a direction opposite the direction of the force of gravity, and with "downward" and like words meaning in the direction of the force of gravity. Such words are used in the context of the towel dispenser standing upright on a generally planar support surface in accordance with the intended use of the dispenser as described herein and represented in the drawings.

Referring now to the drawings, embodiments of the present invention are next described. The following description of the embodiments is merely exemplary in nature and is in no way intended to limit the invention, its implementations, or uses.

FIG. 1 illustrates a perspective view of an automatic paper towel dispenser apparatus 10 in accordance with one embodiment of the present invention. The apparatus 10 preferably dispenses common, readily available, perforated paper towels. Furthermore, the apparatus preferably has a learning capability, giving it the ability to detect and dispense towels of varying lengths, including full sheets, half sheets, multiple sheets, and abnormally sized sheets. Therefore, a wide variety of perforated towels can be used with the apparatus, including any brand or length available at retail.

A towel dispenser 10 includes a housing 12 and a loading door 14. The housing 12 is configured to stand upright in a vertical orientation and includes an interior curved surface 13 that partially defines a generally cylindrical space for receiving, in a vertical orientation, a toweling assembly. In particular, the loading door 14 is mounted within the space and, in turn, includes an interior curved surface 15 that partially defines a second generally cylindrical space 16 that is generally concentric with and nested within the first generally cylindrical space partially defined by the curved surface 13 of the housing 12. The toweling assembly is received in a vertical orientation within this second space 16. The loading door 14 further defines a bottom wall 17 and a top wall 19 each generally circular in profile, which walls 17,19 respectfully bound the top and bottom of the space 16. The housing 12 further defines a circular platform 21 over which the bottom wall 17 of the loading door 14 is arranged.

The loading door 14—including the bottom and top walls 17,19—is configured to rotate relative to the housing 12 about a generally vertical axis 28 between: an open position, as shown for example in each of FIGS. 1, 2, 7, and 11; and a closed position, as shown for example in each of FIGS. 5, 6, 10, 15, and 16. When the loading door 14 is in the closed position, the curved surface 13 of the housing 12 and the curved surface 15 of the loading door 14 together collectively define a generally complete cylindrical chamber surrounding a toweling assembly contained within the dispenser 10; and when the loading door 14 is in the open position, the curved surface 13 of the housing 12 and the curved surface 15 of the loading door 14 extend in close, overlapping proximity to each other as shown for example in FIGS. 1 and 2, whereby access to and removal and insertion of the toweling assembly is provided.

Preferably a latching mechanism retains the loading door 14 in the closed position, keeping the loading door 14 from opening when the dispenser 10 is used or carried. The latching mechanism includes: a release 32 located on the exterior of the loading door 14 near an edge 33 of the loading door 14; a strike surface of the housing 12; a recess defined in an interior surface of the housing 12 adjacent the strike surface; and a spring-biased bolt 34 located on the top of the loading door 14 and configured to engage and be deflected by the strike surface and then moved into the recess in the housing 12 upon the loading door 14 moving into the closed position. The release 32, when pushed downward in the direction of arrow A in FIG. 5, operates against a spring mechanism urging the bolt 34 into the recess so as to move the bolt 34 out of the recess, thereby permitting the loading door 14 to be moved out of the closed position toward the open position. A similar bolt and latching arrangement preferably is located on the bottom of the loading door 14 and operated by the same release 32.

When the loading door 14 is in the open position, the housing 12 is configured to receive the toweling assembly within the generally cylindrical space 16 of the loading door 14 without obstruction. When the loading door 14 is in the closed position, the housing 12 and the loading door 14 are configured to receive an extent of toweling therebetween for dispensing of the toweling. The installation of the toweling assembly and positioning of the toweling between the housing 12 and loading door 14 is described below with reference to FIGS. 11-16.

Figure 3:
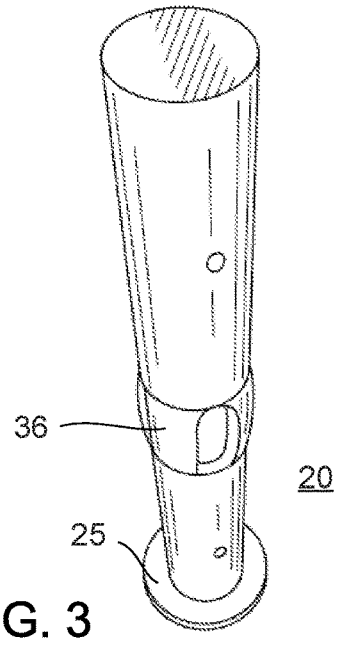
FIG. 3 is a perspective view looking down of the arbor removed from the automatic paper towel dispenser apparatus of FIG. 1.
Figure 4:
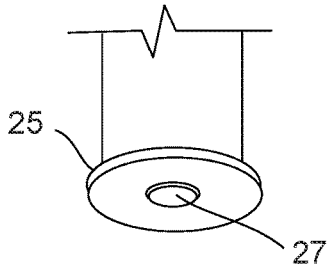
FIG. 4 is a perspective view of a bottom of the arbor of FIG. 3.
Figure 5:
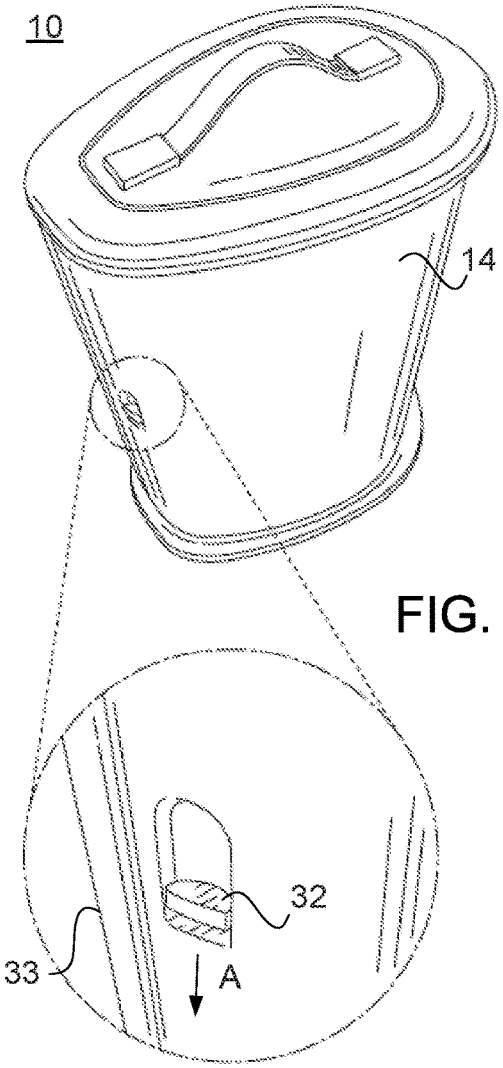
FIG. 5 is a perspective view of the automatic paper towel dispenser apparatus of FIG. 1, wherein the loading door is in a closed position, and wherein a release of a latching mechanism located on the loading door of the dispenser is shown in an enlarged view.
Figure 6:
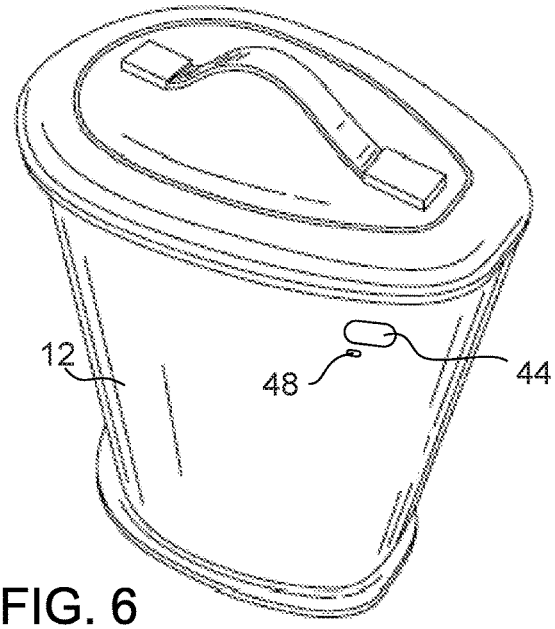
FIG. 6 is a perspective view of the opposite side of the automatic paper towel dispenser apparatus as shown in FIG. 5.
Figure 7:
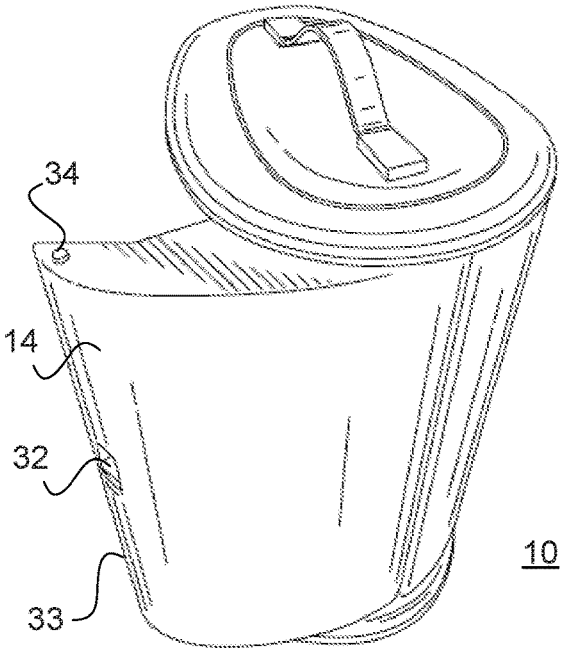
FIG. 7 is a perspective view of the automatic paper towel dispenser apparatus of FIG. 1, wherein the loading door is shown in the open position.
Figure 8:
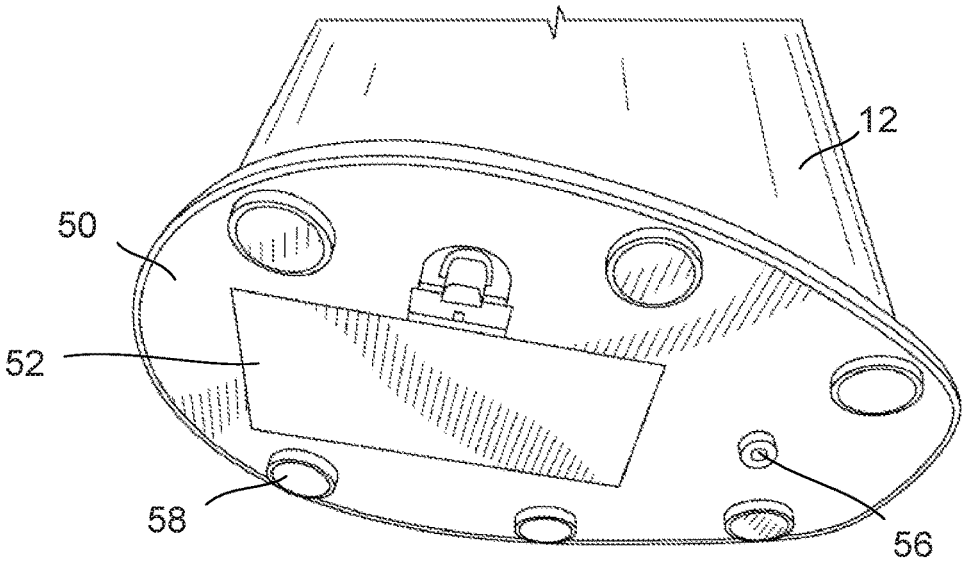
FIG. 8 is a perspective view of the bottom of the automatic paper towel dispenser of FIG. 1.

The toweling assembly preferably includes a roll of perforated paper towels 18 (as shown in FIGS. 11-15) that are disposed on an arbor 20. The arbor is perhaps best seen in FIGS. 1, 3, and 4. The roll of towels may comprise a perforated roll of towels, and preferably comprises a conventional roll of perforated paper towels. The arbor 20 extends through an axial opening of the roll of towels 18 and, preferably, through a conventional cardboard spool on which the length of perforated paper towels are wound. The arbor 20 preferably is removable from the roll of towels 18 by sliding of the arbor 20 relative to the cardboard spool, such that a subsequent roll of towels is disposable on the arbor 20 for reuse thereof in the towel dispenser 10.

Furthermore, the arbor 20 preferably includes a section 36 comprising an enlarged portion or bulge for frictional engagement with and support of the spool on which the roll of towels 18 are wound during unwinding. The arbor 20 also is configured for vertical positioning and support within the loading door 14 between the bottom and top walls 17,19. In particular, the arbor 20 includes a base 25 with circular hub 27 that is received within a recess 29 defined in the bottom wall 17 of the loading door 14 and converging generally toward the axis 28. The top of the arbor 20 is positioned in close proximity to the top wall 19 such that the arbor 20 and toweling mounted thereon is supported and maintained in a generally vertical orientation when the loading door 14 is closed during unwinding and dispensing of toweling. Moreover, it will be appreciated that the axis 28, about which the loading door 14 rotates, further represents a axis about which the arbor 20 generally rotates when correctly positioned within the space 16 during unwinding and dispensing of toweling.

To effect dispensing, the housing includes a motor assembly operatively connected by a transmission to one or more rollers that engage toweling extending between the housing 12 and the loading door 14 when the loading door 14 is closed. The one or more rollers may comprise one or more rollers 22 arranged along a vertical section 26 of an interior section of the loading door 14; one or more rollers 24 extending along a corresponding section of the housing 12; and combination thereof.

Preferably, a plurality of rollers 22 are provided along the vertical section 26 of the loading door, and a plurality of rollers 24 are provided along the corresponding section of the housing 12. Furthermore, one or more of the rollers 24 of the housing preferably are driven directly through a transmission by the motor assembly of the dispenser 10. Such rollers are preferably mounted such that each roller rotates about a common axis, which axis is fixed relative to the housing 12. In contrast, the rollers 22 of the loading door each preferably is mounted such that the respective roller 22 is spring-biased or spring-loaded towards the rollers 24 of the housing 12 and thereby maintained in tensioned engagement when the loading door 14 is closed, and each rotates about an axis that is independent of the axes of the other rollers 22 of the loading door 14.

Preferably the dispenser 10 further comprises a sensor 40 mounted on an interior surface of the housing 12 facing the loading door 14 when the loading door 14 is closed. The sensor 12 is configured to sense a leading edge 88 of the toweling between a spacing or gap 42 formed by and between the housing 12 and the loading door 14 when the loading door 14 has been moved into the closed position.

The dispenser 10 further comprises a second sensor 44 located on an exterior surface of the housing 12 for detecting an object or motion and for causing, in response thereto, the motor assembly of the housing 12 to drive one or more rollers for advancing toweling outside of the housing 12. Preferably, the sensor 44 is configured to detect a hand or a wave of a hand. The sensor also preferably is located proximate a top 46 of the housing 12. A light indicator 48 for indicating a status of the towel dispenser 10 also is provided. The light indicator 48 may comprise one or more LEDs for indicating a status of the towel dispenser 10. The light indicator 48 preferably is located on an exterior surface of the housing 12 near the top 46 of the housing 12, too.

Figure 9:
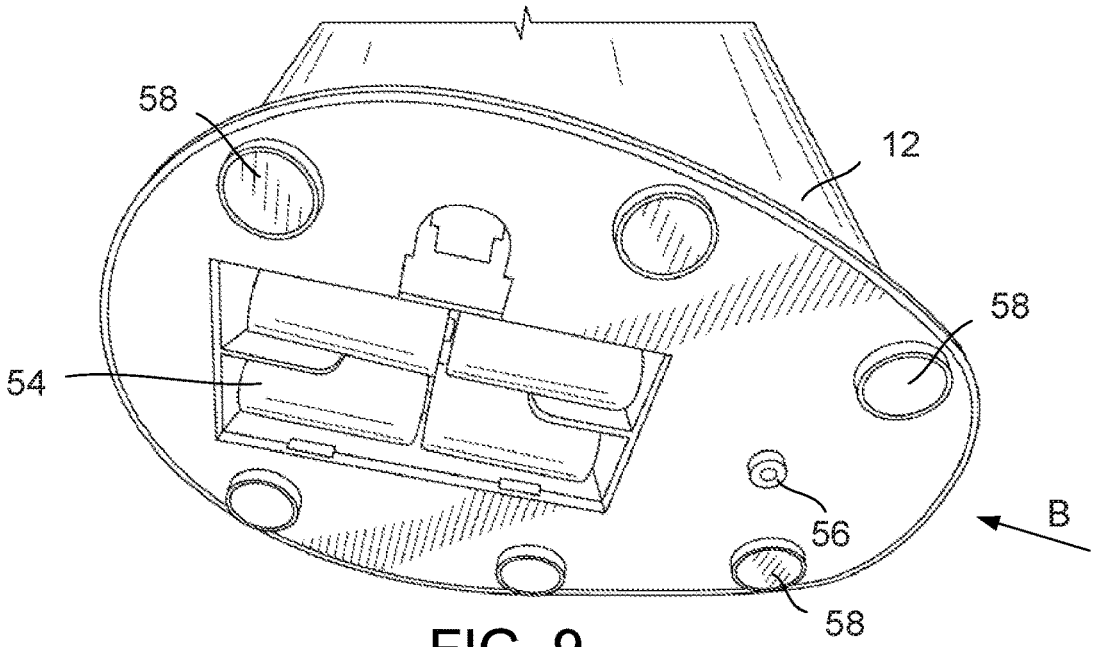
FIG. 9 is a perspective view of the bottom of the automatic paper towel dispenser of FIG. 1, wherein an access panel has been removed to reveal batteries for powering a motor assembly of the apparatus.

The dispenser 10 preferably is battery operated. The batter compartment preferably is located at a bottom or base 50 of the dispenser 10. An access panel 52 is removable for accessing and replacing the batteries 54, comprising four D size batteries as shown in FIG. 9. In addition to being battery operated, a dispenser in accordance with a feature of the invention may be powered by an electrical cord plugged into a conventional wall outlet. To this end, a dispenser may include an electrical receptacle for receiving an power plug, as shown in the Appendix.

The dispenser 10 also includes a handle comprising a strap 30 attached to the top 46 of the housing 12 for carrying of the dispenser 10. To this end, the dispenser 10 preferably is sized and shaped to be hand portable, including being sufficiently light weight for portability.

Figure 10:
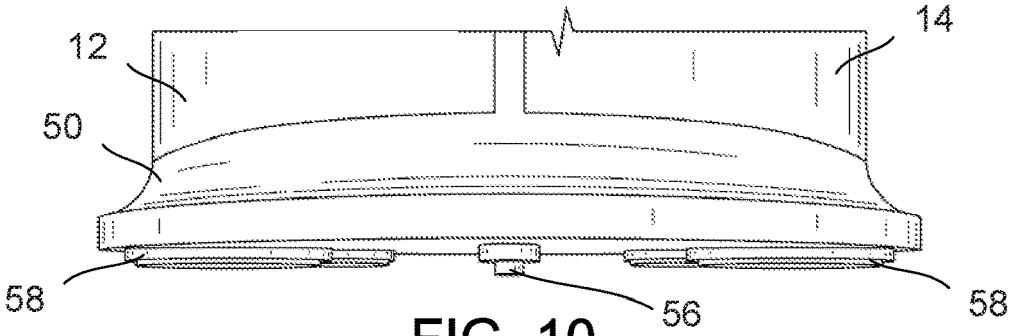
FIG. 10 is an elevational view of the bottom of the automatic paper towel dispenser apparatus, which view is taken in the direction of arrow B shown in FIG. 9.

In order to prevent inadvertent dispensing of toweling during carriage of the dispenser 10, a safeguard preferably is included in the dispenser 10. The safeguard may comprise a switch, toggle, or other mechanism, and preferably is automatically overridden when the dispenser 10 is physically positioned in an upstanding orientation for dispensing. In preferred embodiments, the safeguard comprises a depressible button 56 located on the bottom 50 of the housing 12 that prevents dispensing of toweling unless the button 56 is depressed. As shown in FIG. 10, the button 56 is configured (preferably spring biased) to extend downwardly an extent beyond feet 58 of the housing, whereby the button 56 is automatically depressed when the housing 12 is positioned on a support surface (such as a surface of a table) in an upright, vertical orientation, with the feet 58 engaging such surface. This guards against undesired dispensing of toweling when the dispenser 10 is picked up and carried.

The safeguard alternatively may comprises a switch, slide, toggle, or other control that is manually actuated by hand. In this regard, the safeguard is not an on/off switch for turning power to the motor assembly on and off, insofar as it is desired that the safeguard be engaged or otherwise active while power nonetheless is supplied to the dispenser such that one or more configuration settings of the dispenser that may have been saved to transitory memory are not lost due to power being cutoff. The safeguard thus holds or disables dispensing without shutting off power. Such settings may include, for example, a unit length saved to memory and representing an extent of the toweling that is advanced for each hand wave. Such unit length can be set in accordance with the length learn methodology of the incorporated patent references that is preferably utilized each time toweling is inserted into the dispenser.

Figure 11:
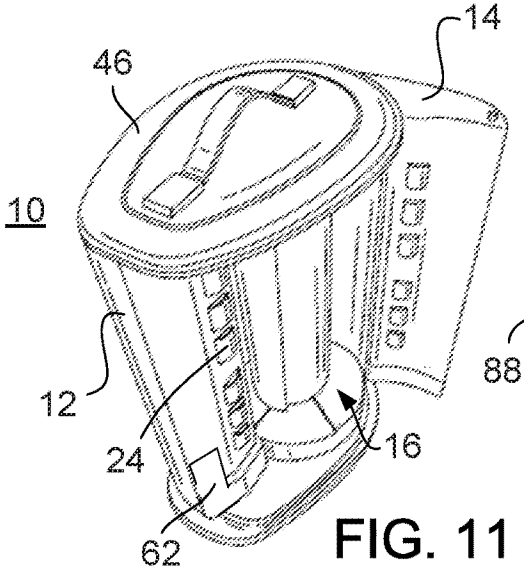
FIGS. 11-16 are perspective views of the automatic paper towel dispenser apparatus representing a sequence of installing a toweling assembly therein for dispensing.

With reference now to FIGS. 11-16, installation of the toweling assembly and positioning of an extent of the toweling between the housing 12 and loading door 14 is described. The towel dispenser 10 is configured to receive the toweling assembly therein for dispensing by moving the loading door 14 to the open position, as shown in FIG. 11. The arbor 20 is pushed through the axial passage of a roll of perforated paper towels, and the towel assembly inserted into and positioned in the space 16 for dispensing. In positioning the toweling assembly within the space 16, the axis of the arbor 20 is generally aligned with the axis 28 of the rotation of the loading door 14. The hub 27 of the bottom 25 of the arbor 20 is received within the recess 29 of the bottom 17 of the loading door 14 such that the toweling assembly is rotatable while supported in the vertical orientation in the loading door 14.

Next, an extent of toweling from the roll of paper towels 18 is unwound and positioned to extent out of the space 16. The extent of toweling that is unwound form the roll of paper towels 18 may be held by hand to maintain a correct position thereof during the process. This may be effectively accomplished by wrapping the extent of the toweling over edge 33 of the loading door and gripping the edge of the loading door 14, pinning the extent of toweling thereto.

Figure 12:
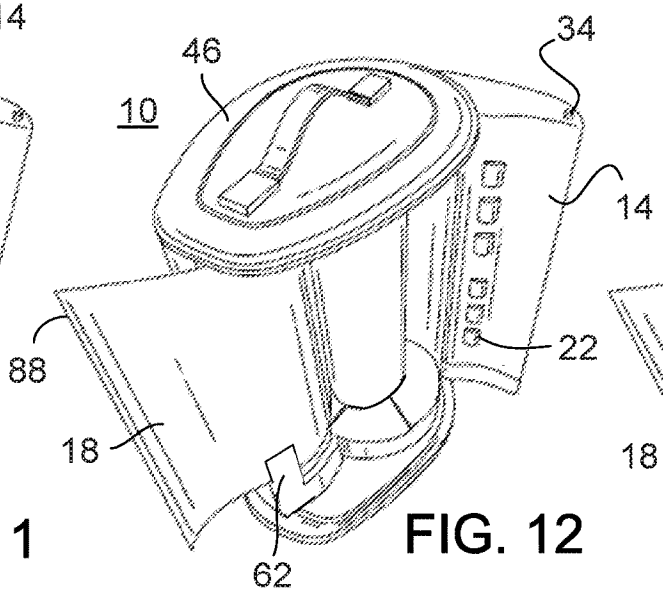

Alternatively, for hands-free maintenance of the extent of the toweling that is unwound, the extent of the toweling is maintained by positioning a small portion of the bottom of the toweling within a channel 60 formed by wall 62. FIG. 12 illustrates the extent of the toweling being so positioned, with the leading edge 18 extending beyond the housing 12 of the dispenser 10, and with the extent of toweling extending over and covering the rollers 24 of the housing 12. The channel 62 formed by the wall 62 assists in keeping the extent of the toweling in an upright orientation during closing of the loading door 14.

Figure 13:
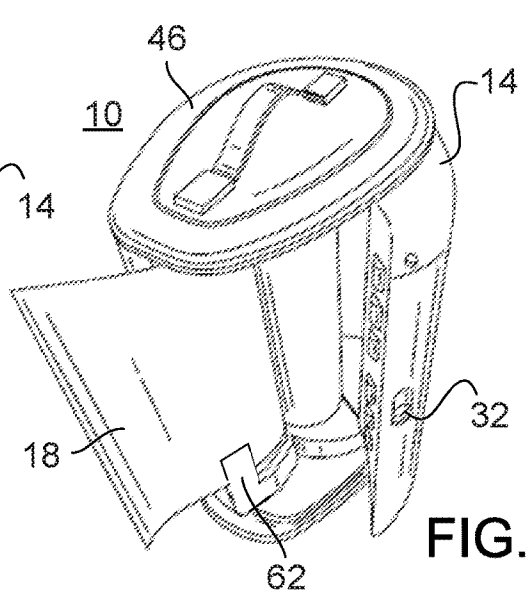
Figure 14:
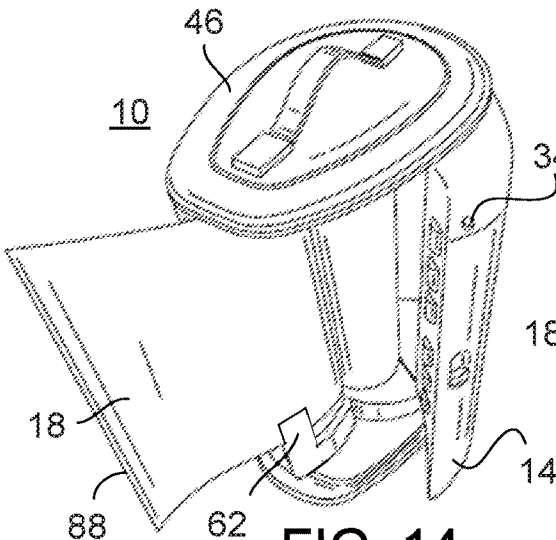
Figure 15:
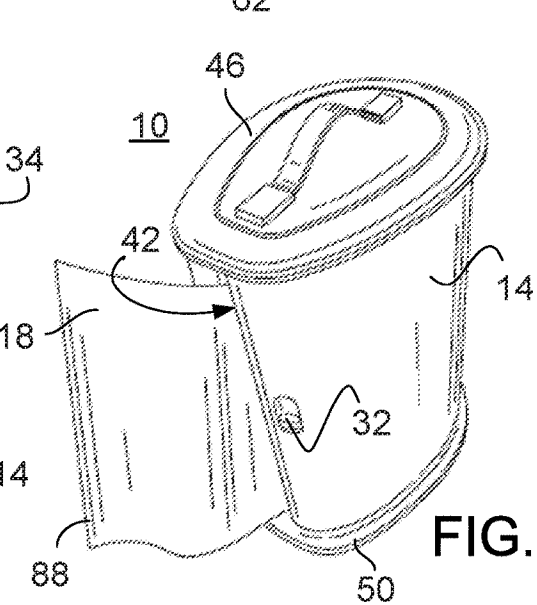

Next, the loading door 14 is moved into the closed position, as shown in FIGS. 13-15, with the extent of the toweling remaining positioned between the loading door 14 and the housing 12 such that the toweling is threaded between the rollers 22 of the loading door 14 and the rollers 24 of the housing 14 upon closing of the loading door 14 and receipt of the bolt within the recess of the locking mechanism.

Figure 16:
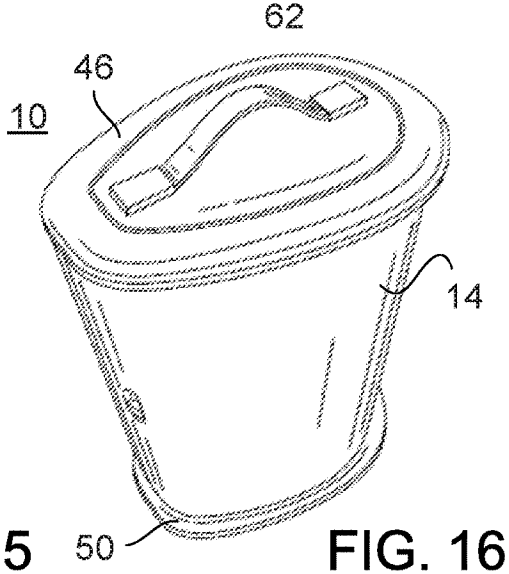

Furthermore, upon locking of the loading door 14 in the closed position, the motor assembly is activated to drive retraction of the extent of toweling extending outside of the housing 12 back into the housing 12. The sensor 40 detects the leading edge 88 of the extent of the toweling during such retraction and triggers the motor assembly to stop driving further retraction of the toweling, the extent of the toweling at that point no longer extending exteriorly of the housing 12, as shown in FIG. 16. At this point, a length learn sequence is performed for setting the length of toweling to be extended from the housing upon actuation of the sensor 44, as disclosed in one or more of the incorporated U.S. patent references.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested herein, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A sheet material dispenser, the sheet material dispenser comprising:

a housing comprising a top and a bottom, wherein the bottom supports the housing in a vertical orientation, wherein the housing further defines an interior space sized to receive a sheet material roll in a vertical orientation for vertical support thereof during dispensing of sheet material from the sheet material roll;

a loading door rotatably connected to the housing, wherein the loading door rotates between a closed position covering the interior space and an open position, wherein, when the loading door is in the open position, a sheet material roll is able to be inserted into the interior space;

a housing roller positioned on the housing so as to engage a leading edge of the sheet material from the sheet material roll when the loading door is in the closed position and the sheet material roll is installed within the interior space with the leading edge of the sheet material roll extending between the loading door and the housing; and a motor assembly operatively connected to the housing roller to cause dispensing of a portion of the sheet material from the sheet material roll.

2. The sheet material dispenser of claim 1, wherein, in an instance in which the loading door is in the closed position, the loading door and the housing define a gap sized to receive the leading edge of the sheet material and enable dispensing of the portion of the sheet material roll therethrough.

3. The sheet material dispenser of claim 1 further comprising a loading door roller positioned on the housing to engage the leading edge of the sheet material from the sheet material roll when the loading door is in the closed position and the sheet material roll is installed within the interior space with the leading edge of the sheet material roll extending between the loading door and the housing.

4. The sheet material dispenser of claim 1 further comprising a plurality of loading door rollers, wherein the plurality of loading door rollers extend along an interior side of the loading door and a plurality of housing rollers that extend along a corresponding section of the housing when the loading door is in the closed position.

5. The sheet material dispenser of claim 1 further comprising a sensor located on an interior of the housing and configured to sense a leading edge of the sheet material relative to the loading door.

6. The sheet material dispenser of claim 1 further comprising a sensor located on an exterior of the housing and configured to detect motion, wherein the sensor is operatively connected to the motor assembly and configured to cause the motor assembly to drive the housing roller to cause dispensing of the portion of the sheet material roll in an instance in which an object or motion is detected by the sensor.

7. The sheet material dispenser of claim 1 further comprising a strap for carrying of the sheet material dispenser.

8. The sheet material dispenser of claim 1 further comprising a light indicator for indicating a status of the sheet material dispenser, the light indicator being located on an exterior surface of the housing.

9. The sheet material dispenser of claim 1 further comprising a safeguard located on the bottom of the housing, wherein the safeguard prevents dispensing of the sheet material from the sheet material roll in an instance in which the bottom of the housing is not positioned on a surface.

10. The sheet material dispenser of claim 1, wherein the interior space is further sized to receive an arbor that supports the sheet material roll.

11. The sheet material dispenser of claim 10, wherein the arbor is removable from the sheet material roll, such that a second sheet material roll is positionable on the arbor for use in the sheet material dispenser.

12. The sheet material dispenser of claim 1 further comprising a wall feature positioned to retain a portion of the leading edge of the sheet material of the sheet material roll to cause the leading edge to maintain an upright orientation when the sheet material roll is loaded into the interior space and the loading door is in the open position.

13. The sheet material dispenser of claim 12, wherein the wall feature is positioned relative to the housing to form a channel sized to receive the portion of the leading edge of the sheet material of the sheet material roll.

14. A sheet material dispenser, the sheet material dispenser comprising:

a housing comprising a top and a bottom, wherein the bottom supports the housing in a vertical orientation, wherein the housing further defines an interior space sized to receive a sheet material roll in a vertical orientation for vertical support thereof during dispensing of sheet material from the sheet material roll;

a loading door rotatably connected to the housing, wherein the loading door rotates between a closed position covering the interior space and an open position, wherein, when the loading door is in the open position, a sheet material roll is able to be inserted into the interior space;

a loading door roller positioned on the loading door to engage a leading edge of the sheet material from the sheet material roll when the loading door is in the closed position and the sheet material roll is installed within the interior space with the leading edge of the sheet material roll extending between the loading door and the housing; and a motor assembly operatively connected to the loading door roller to cause dispensing of a portion of the sheet material from the sheet material roll.

15. The sheet material dispenser of claim 14, wherein, in an instance in which the loading door is in the closed position, the loading door and the housing define a gap sized to receive the leading edge of the sheet material and enable dispensing of the portion of the sheet material roll therethrough.

16. The sheet material dispenser of claim 14 further comprising a housing roller positioned on the housing to engage the leading edge of the sheet material from the sheet material roll when the loading door is in the closed position and the sheet material roll is installed within the interior space with the leading edge of the sheet material roll extending between the loading door and the housing.

17. The sheet material dispenser of claim 14 further comprising a plurality of loading door rollers, wherein the plurality of loading door rollers extend along an interior side of the loading door and a plurality of housing rollers that extend along a corresponding section of the housing when the loading door is in the closed position.

18. A sheet material dispenser, the sheet material dispenser comprising:

a housing comprising a top and a bottom, wherein the bottom supports the housing in a vertical orientation, wherein the housing further defines an interior space sized to receive a sheet material roll in a vertical orientation for vertical support thereof during dispensing of sheet material from the sheet material roll;

a loading door rotatably connected to the housing, wherein the loading door rotates between a closed position covering the interior space and an open position, wherein, when the loading door is in the open position, a sheet material roll is able to be inserted into the interior space;

a housing roller positioned on the housing so as to engage a leading edge of the sheet material from the sheet material roll when the loading door is in the closed position and the sheet material roll is installed within the interior space with the leading edge of the sheet material roll extending between the loading door and the housing;

a loading door roller positioned on the loading door to engage the leading edge of the sheet material from the sheet material roll when the loading door is in the closed position and the sheet material roll is installed within the interior space with the leading edge of the sheet material roll extending between the loading door and the housing; and a motor assembly operatively connected to at least one of the housing roller or the loading door roller to cause dispensing of a portion of the sheet material from the sheet material roll.

19. The sheet material dispenser of claim 18, wherein the loading door roller is positioned on the loading door at a loading door position that corresponds to a housing position of the housing roller on the housing such that the loading door roller and the housing roller sandwich the leading edge of the sheet material therebetween in an instance in which the loading door is in the closed position and the sheet material roll is installed within the interior space with the leading edge of the sheet material roll extending between the loading door and the housing.

20. The sheet material dispenser of claim 18, further comprising:

a sensor located on an exterior of the housing and configured to detect motion; and a controller operatively connected to the sensor and the motor assembly and configured to receive sensor data indicative of user activation and, in response, cause the motor assembly to drive the at least one of the housing roller or the loading door roller to cause dispensing of the portion of the sheet material roll.

* * * * *